United States Patent [19]

Wells

[11] Patent Number: 4,577,903

[45] Date of Patent: Mar. 25, 1986

[54] WHEELCHAIR ATTACHED STORAGE BAG

[76] Inventor: Carol L. Wells, 1897 Citrus Hill Rd., Palm Harbor, Fla. 33563

[21] Appl. No.: 595,964

[22] Filed: Apr. 2, 1984

[51] Int. Cl.[4] ..... A47C 7/62

[52] U.S. Cl. ..... 297/188; 297/191; 297/DIG. 4

[58] Field of Search ..... 297/191, 188, DIG. 4

[56] References Cited

U.S. PATENT DOCUMENTS

| | | | |
|---|---|---|---|
| 2,225,532 | 12/1940 | Sallop | 297/191 X |
| 2,545,336 | 3/1951 | Binder | 297/191 X |
| 2,703,426 | 3/1955 | Barkl | 297/191 X |
| 2,724,429 | 11/1955 | Warner | 297/188 |
| 3,970,344 | 7/1976 | Baumann | 297/DIG. 4 |
| 4,179,159 | 12/1979 | Sieklucki et al. | 297/DIG. 4 |
| 4,184,618 | 1/1980 | Jones | 297/5 |
| 4,339,061 | 7/1982 | Dunn | 297/DIG. 4 |
| 4,431,206 | 2/1984 | Pryor | 297/191 X |
| 4,449,750 | 5/1984 | Pultman | 297/188 |

*Primary Examiner*—Francis K. Zugel

*Attorney, Agent, or Firm*—Harvey B. Jacobson

[57] ABSTRACT

An attachment for a wheel chair in the form of a storage bag supported vertically between the rearwardly extending handles at the upper end of the wheelchair frame and a pair of bottom tip bars in such a manner that it can be folded with the wheelchair and provide a convenient and readily accessible storage area for various articles. The storage bag may be constructed of various flexible materials, provided with pockets if desired, provided with an open top if desired, provided with a zipper closure or other similar closure if desired and provided with sleeves or loops which receive the rearwardly extending handles and the bottom frame members or tip bars at the lower end of the wheelchair with the storage bag being retained in taut condition so that it does not interfere with rotation of the wheels nor become entangled with the wheels or soiled by engaging the wheels thereby enabling the wheelchair to be operated in the usual manner either by the occupant of the wheelchair or by a person pushing or otherwise manipulating the wheelchair by engagement with the rearwardly extending handles.

5 Claims, 6 Drawing Figures

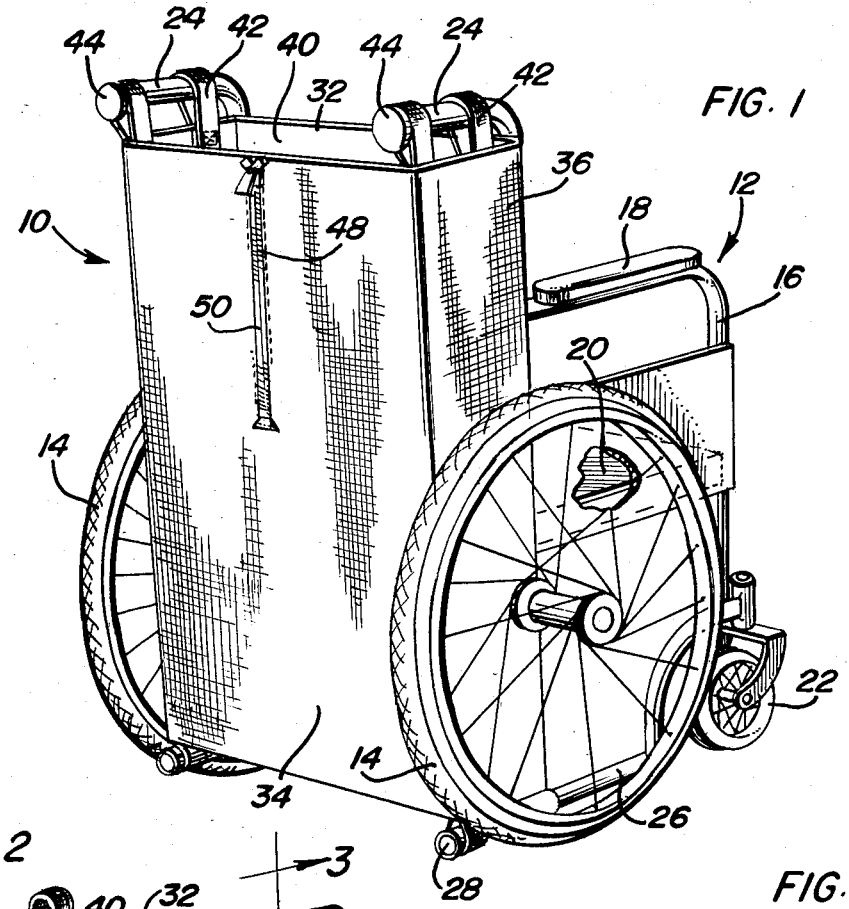
FIG. 1
FIG. 2
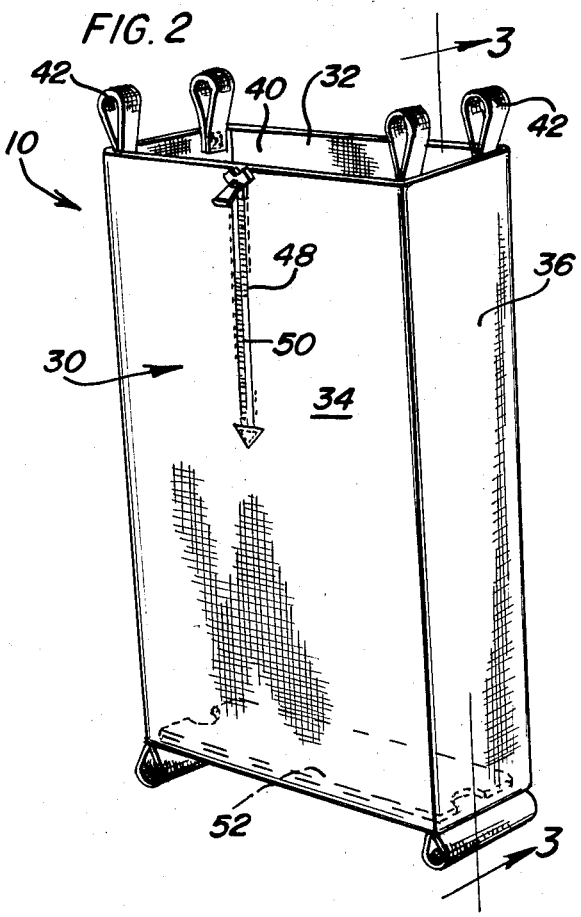
FIG. 6
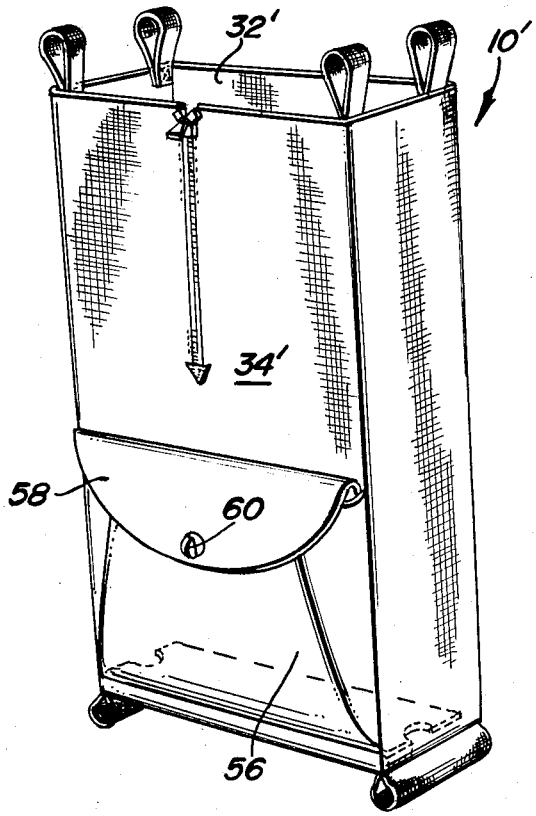

WHEELCHAIR ATTACHED STORAGE BAG

BACKGROUND OF THE INVENTION

1. Field of the Invention

The present invention generally relates to an attachment for a wheelchair and more specifically to a storage bag removably secured between the rearwardly extending handles of a wheelchair and the rearwardly extending tip bars at the lower end of the wheelchair frame with the storage bag being vertically disposed and constructed of flexible material and provided with openings for access to the interior thereof for storage and retrieval of various articles with the flexible construction of the bag enabling it to be folded along with the wheelchair for storage or transport in a folded condition.

2. Description of the Prior Art

Persons occupying a wheelchair frequently want to carry various loose articles which sometimes are dropped, become disarranged and otherwise cause an inconvenience to the occupant of the wheelchair or the person that may be pushing the wheelchair. Some efforts have been made to provide storage racks and the like for articles desired to be retained by a wheelchair occupant. U.S. Pat. No. 4,403,786 discloses one such effort in which a basket-type container is supported in front of the wheelchair. The following U.S. patents are also relevant to this invention:

| | | |
|---|---|---|
| 2,545,336 | R. S. Binder | Mar. 13, 1951 |
| 2,659,420 | C. E. Burke | Nov. 17, 1953 |
| 3,151,909 | R. E. Gerdetz | Oct. 6, 1964 |

SUMMARY OF THE INVENTION

An object of the present invention is to provide a wheelchair attachment in the form of a storage bag supported vertically at the rear of the wheelchair and being removably connected between the rearwardly extending handles at the upper end of the wheelchair frame and the rearwardly extending tip bars at the lower end of the wheelchair frame with the storage bag being retained in taut but removable condition with respect to the wheelchair.

Another object of the invention is to provide a wheelchair attached storage bag constructed of flexible material enabling the storage bag to be folded along with the wheelchair.

A further object of the invention is to provide a wheelchair attached storage bag having an open top, slidable-type closure or other type closure, separate storage compartments and the like to facilitate storage of various articles in a convenient and readily accessible manner.

Still another object of the invention is to provide a wheelchair attached storage bag which is simple in construction, easy to mount on the wheelchair and remove therefrom when desired, constructed to eliminate interference with the wheels of the wheelchair and capable of carrying various size articles in an effective manner with the bottom of the flexible storage bag having a removable stiffening element to shape the bag when in use but being liftable to a vertical position when the storage bag and wheelchair are folded.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 1 is a perspective view of a wheelchair with the storage bag of the present invention assembled thereon.

FIG. 2 is a perspective view of the storage bag.

FIG. 6 is a perspective view of another embodiment of the storage bag.

DESCRIPTION OF THE PREFERRED EMBODIMENTS

Figure 3:
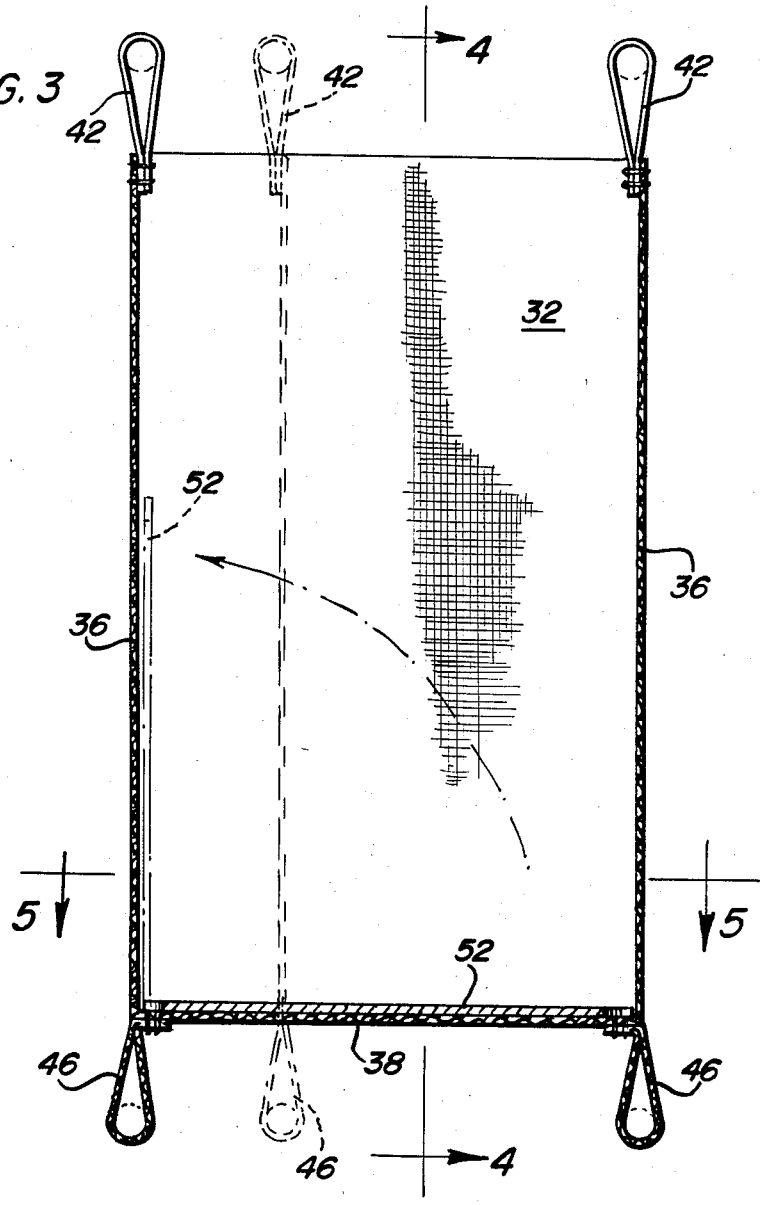
FIG. 3 is a vertical sectional view taken substantially upon a plane passing along section line 3—3 on FIG. 2 illustrating the structural details of the storage bag.
Figure 4:
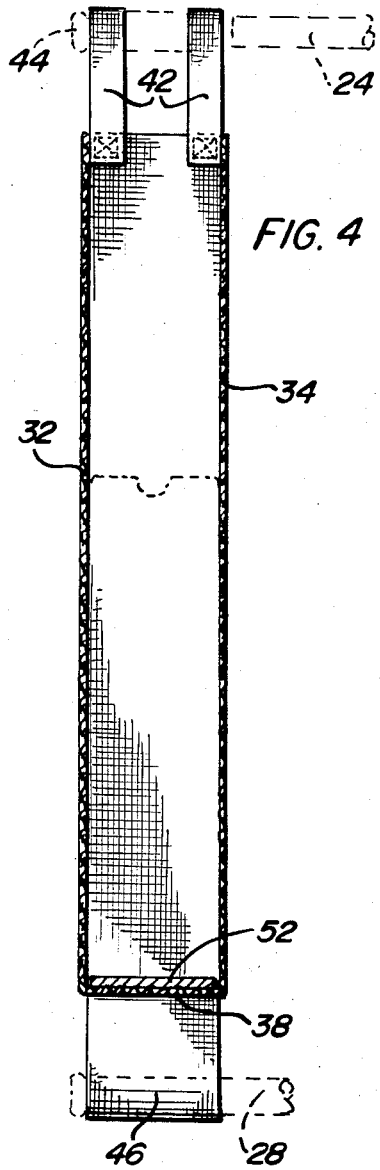
FIG. 4 is a vertical sectional view taken substantially upon a plane passing along section line 4—4 on FIG. 3 illustrating further structural details of the storage bag.
Figure 5:
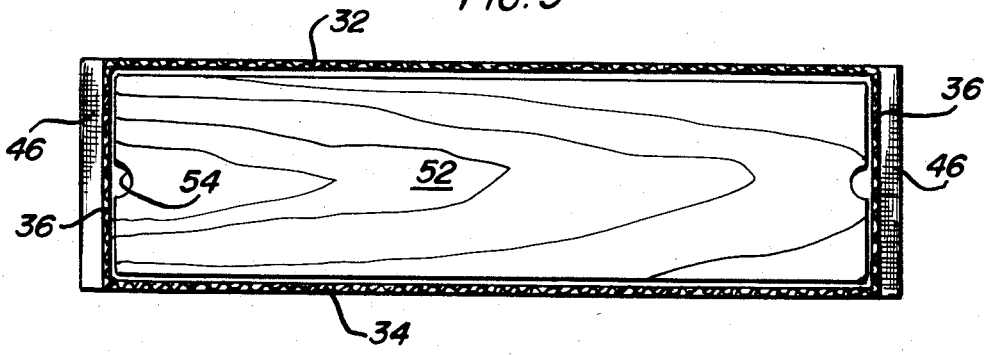
FIG. 5 is a transverse, sectional view taken substantially upon a plane passing along section line 5—5 on FIG. 3 illustrating further structural details of the storage bag.

Referring now specifically to the drawings, the storage bag of the present invention is generally designated by reference numeral 10 and is associated with and supported from a conventional folding wheelchair 12 with the bag being of flexible construction for folding with the wheelchair when it is folded for transport, storage and the like. The wheelchair includes the usual relatively large diameter side wheels 14 supporting a frame structure 16 which includes the usual arm rests 18 and an occupant seat 20. The lower front of the frame 16 is supported by smaller wheels 22 which may be caster wheels or the like. The structure of the wheelchair 12 is conventional and is in no way modified to receive the storage bag 10 of the present invention. As illustrated, the wheelchair 12 includes a pair of rearwardly extending handles 24 oriented at each side of the wheelchair, above the wheels 14 and extending rearwardly from the occupant's seat area. Also, the wheelchair frame 16 includes lower rails 26 terminating in rearwardly extending tip bars 28 which are in spaced parallel and generally aligned relation with respect to the handles 24 with the tip bars 28 being disposed inwardly of the side wheels 14 in a conventional and well known manner.

The storage bag 10 includes a generally rectangular receptacle 30 including a vertically disposed rectangular front wall 32, a similarly shaped rear wall 34 and sidewalls 36 interconnected at their bottom by a bottom wall 38 to define a receptacle 30 having an open top 40. The upper edge of each sidewall 36 is provided with a pair of spaced, aligned loops 42 which are adapted to be positioned on and to receive the handles 24 as illustrated in FIG. 1 with the rearmost loop 42 being retained on the handles by an enlargement or knob 44 normally provided on handles 24. The transverse width of the receptacle 30 is generally equal to the distance between the handles 24 so that the loops 42 extend vertically from the top edges of the sidewalls 36 and are removably mounted on the handles 24. The bottom edge of each sidewall 36 is provided with an elongated, continuous sleeve 46 which depends therefrom and which is dimensioned to be received on the tip bars 28 as illustrated in FIG. 1 with the tip bars 28 also including an enlargement or knob on the outer free end thereof to retain the sleeve 46 thereon but yet enable it to be easily removed. The vertical dimensions of the receptacle 30 are such that when the loops 42 are postioned on the handle 24 and the sleeves 46 positioned on the tip bars 28, the receptacle 30 will be in a taut condition substantially as illustrated in FIG. 1 with the open top 32 being disposed immediately adjacent and between the handles 24 to enable articles to be easily placed into or removed from the bag 10.

The rear wall 34 of the receptacle 30 is provided with an elongated slit-like opening 48 extending from the upper edge thereof downwardly toward the vertical center of the wall 24 with a slide-type closure such as a zipper 50 being provided to selectively open and close the slit-like opening thereby further enabling easy access to the interior of the storage bag 10 when the zipper closure 50 is open which enables the upper corners of the opening 48 to fold downwardly and outwardly thereby, in effect, shortening the vertical height of the bag so that a person may reach into the bag and retrieve articles in the bottom end thereof. A rigid panel 52 of wood, heavy cardboard, plastic or other substantially rigid material is provided in the bottom of the storage bag and rests on the upper surface of the bottom wall 38 thereby providing a firm bottom which will not sag into contact with the ground, floor or other supporting surface. When the storage bag 10 is to be folded along with the folding wheelchair, the rigid panel 52 may be removed or merely pivoted to a vertical position as illustrated in FIG. 3. The end edges of the panel 52 are provided with notches 54 to facilitate a finger engaging the end of the panel 52 in order to remove it or move it to the vertical position as shown in broken-lines in FIG. 3.

FIG. 6 illustrates a slightly modified form of the invention in which the storage bag 10' includes an externally mounted pocket 56 on the rearward wall 34'. The flexible pocket 56 is provided with a closure flap 58 at its upper end and a fastener 60 to retain the closure flap 58 in closed position to the pocket 56. This provides an additional storage space for articles in order to keep them separated from any articles within the interior of the storage bag.

In both embodiments of the invention, all of the components of the storage bag are constructed of flexible material such as fabric, plastic material or various combinations of flexible material which do not adversely affect the folding of the wheelchair when all of the articles have been removed from the storage bag 10 and the rigid panel either removed or positioned in a vertical position. The front-to-rear dimensions of the storage bag 10 is such that the rearward wall 34 is disposed forwardly of the rear portions of the supporting wheels 14 and the spaced loops 42 still enable a person pushing the wheelchair to manipulate and walk behind the wheelchair in the usual manner. Also, the addition of the storage bag does not in any way alter the capability of the occupant of the wheelchair propelling the wheelchair in the usual manner. Further, the open top 40 of the storage bag 10 positioned immediately rearwardly of the occupant does not interfere with the occupant getting into the wheelchair or getting out of the wheelchair and does not interfere with movement of the hands of the occupant such as might occur when the occupant is purchasing articles, paying for them at a checkout counter and the like. Also, the open top at the handle area enables the occupant in the wheelchair to drop articles into the storage bag by merely reaching over his shoulder and dropping the article into the top of the bag.

While the dimensions of the storage bag may vary, in one practical embodiment, the storage bag has been constructed with a width of approximately 18 inches, a vertical height of approximately 29½ inches and a front-to-rear width of approximately 5 inches. The bag may be constructed of bright colors and may be of canvas material, denim, vinyl, leather, quilted or the like. The pocket and closure arrangements may vary depending upon the individual desires of the user. For example, two external pockets of smaller sizes may be provided, a horizontal zipper closure may be provided adjacent the bottom of the storage bag, an external pocket may be provided with an open top having a hem with a resilient member therein to snug the open top against the rear wall of the storage bag. Also, the upper end of the storage bag can be closed if desired and may be concavely curved rather than being straight across as indicated. Also, instead of the pair of spaced loops at the upper end, the means for attaching the upper end of the bag to the handles may also be a continuous sleeve if desired and the sleeves and loops may be constructed of leather, vinyl or other strong material or may be the same material as the flexible material from which the bag is constructed. Another type of closure which may be used is a top flap secured to the upper edge of the front wall, overlying the open upper end of the storage bag and extending downwardly along the outer surface of the rear wall and being secured in place by a fastener at the bottom end of the flap.

The wheelchair attached storage bag of this invention is useful by a person using the wheelchair by occupying the wheelchair or by using the wheelchair by pushing the wheelchair with an occupant therein. The storage bag provides a convenient place to carry various articles which usually are retained loosely on the occupant's lap or placed in a loosely hanging bag, sometimes attached to the arm rest and which frequently gets caught in the supporting wheel or soiled by the supporting wheel. The storage bag is mounted semi-permanently in that it can be removed and also be folded with the wheelchair for transport in an automobile or the like. The storage bag is especially effective when shopping in a shopping mall and the like inasmuch as purchases can be placed in the storage bag. A student, athlete or the like may easily store all equipment, books and the like in the storage bag. The storage bag is launderable when removed and can be constructed of various materials. The closure arrangement may be provided with a lock feature to provide security for articles stored in the bag and various sized articles may be effectively stored and retained.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. In combination with a wheelchair having a seat for an occupant, a frame with rearwardly extending tip bars at the rear lower ends thereof and a pair of handles at the upper ends thereof, a pair of large wheels supporting said wheelchair, a vertically disposed flexible storage bag oriented rearwardly of the seat, between the rearward portions of the wheels and between the handles and tip bars, said bag including a peripheral wall, means on said bag detachably engaged with said handles and tip bars, and means incorporated into said bag enabling access into the interior thereof, said means on the bag engaging the handles including loops at laterally outer edges of the top of the bag, said means engaging the tip bars including a pair of sleeves at the laterally outer edges of the bottom of the bag to support the bag taut between the handles and tip bars and inwardly of the wheels, said bag being generally of rectangular configuration with a front-to-rear dimension confining the bag to the area between the rear portions of the wheels to eliminate interference with operation of the wheelchair and enabling the bag to fold with the wheelchair when used in combination with a folding wheelchair.

2. The combination of claim 1 wherein said access means includes an open upper end in the peripheral wall, a vertically extending opening said peripheral wall and closure means closing said opening, and a removable rigid panel in the bottom of said bag to prevent the bottom of the bag from sagging downwardly.

3. The combination of claim 2 together with an external storage pocket mounted on the rear of said peripheral wall adjacent the lower end thereof, said pocket including a closure flap at the upper end thereof.

4. In combination, a wheelchair having a seat for an occupant, a frame with rearwardly extending frame members at the lower ends thereof and a pair of rearwardly extending handles at the upper ends thereof, a pair of large side wheels supporting said wheelchair, a vertically disposed storage receptacle oriented rearwardly of the seat, said receptacle extending vertically between the rearward portions of the wheels and between the handles and frame members, means on said receptacle detachably engaged with said handles, means on said receptacle detachably engaged with said frame members, and means incorporated into said receptacle enabling access into the interior thereof, said means on said receptacle engaging the handles extending upwardly from the receptacle and engaging the handles without interfering with normal gripping engagement of the handles by a person pushing the wheelchair, wherein said receptacle is in the form of a flexible bag of generally rectangular configuration and having a front-to-rear dimension confining the bag to the area between the rear portion of the wheels to eliminate interference with operation of the wheelchair, said means on the receptacle engaging the handles including flexible loop means connected with the upper side edge portions of said bag, said means on the receptacle engaging the frame members including flexible sleeve means on the lower side edge portions of the bag for receiving the frame members therethrough, each of the handles and frame members including an enlargement on the free end to retain the loop means and the sleeve means assembled thereon.

5. The combination as defined in claim 4 wherein said storage bag has a vertical dimension to extend substantially from the lower frame members to the handles, said storage bag including an open top oriented horizontally slightly below the handles to enable easy access to the interior of the storage bag by the occupant of the wheelchair seat and by a person pushing the wheelchair.

* * * * *